United States Patent [19]

Kaman, II

[11] 4,188,850

[45] Feb. 19, 1980

[54] FOAMED PLASTIC GUITAR CONSTRUCTION

[75] Inventor: Charles W. Kaman, II, East Killingly, Conn.

[73] Assignee: Kaman Aerospace Corporation, Bloomfield, Conn.

[21] Appl. No.: 855,789

[22] Filed: Nov. 29, 1977

[51] Int. Cl.[2] ..... G10D 1/08

[52] U.S. Cl. ..... 84/291; 84/292; 84/293

[58] Field of Search ..... 84/290, 291, 292, 293, 84/1.15, 1.16

[56] References Cited

U.S. PATENT DOCUMENTS

| | | | |
|---|---|---|---|
| Re. 23,620 | 2/1953 | Finder | 84/291 |
| 3,550,496 | 12/1970 | Fender | 84/293 |
| 3,691,285 | 9/1972 | Larrison | 84/293 |
| 3,911,778 | 10/1975 | Martin | 84/291 |
| 3,915,049 | 10/1975 | Bean | 84/293 |

*Primary Examiner*—L. T. Hix
*Assistant Examiner*—S. D. Schreyer
*Attorney, Agent, or Firm*—McCormick, Paulding & Huber

[57] ABSTRACT

A guitar has a separate body and neck each made of a metallic frame combined with a mass of structural foamed plastic. A solid joint, involving metal to metal contact of the two frames, is provided between the body and the neck and is readily unmade to allow disassembly of the neck from the body for repair or replacement of either the body or the neck. The two frames provide a continuous metallic span from the nut to the bridge to inhibit bending under string tension and also to enhance sustain by reducing damping. The external surface of the neck and body plastic masses may be given a grain effect, color and finish causing such masses to closely simulate wood, yet the use of wood is entirely avoided to avoid its disadvantages such as its tendency to warp, crack or otherwise deteriorate with age and changes in temperature and humidity.

4 Claims, 14 Drawing Figures

Fig. 12
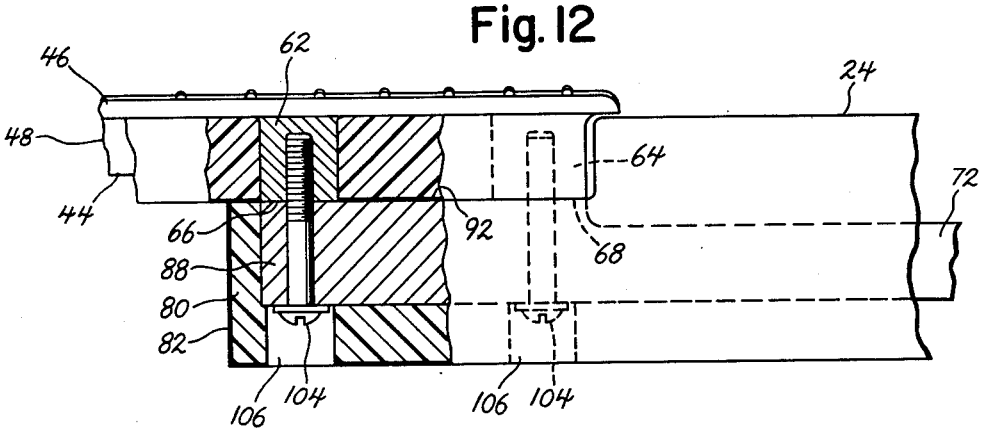
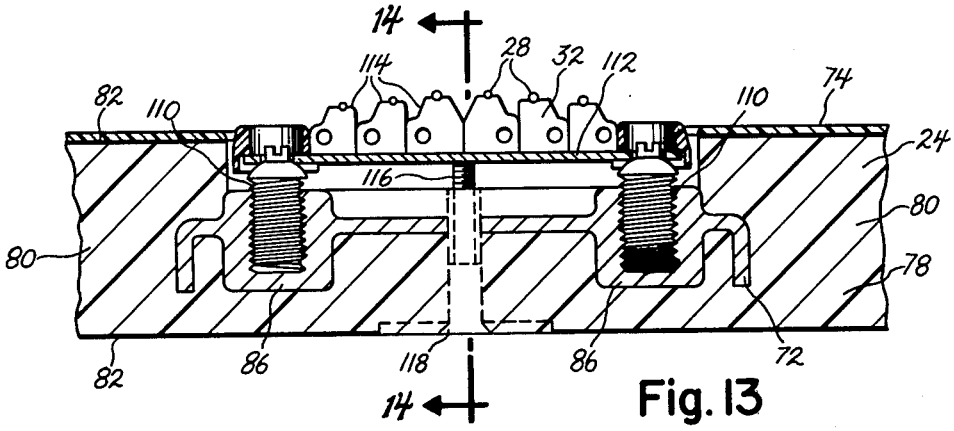
Fig. 13
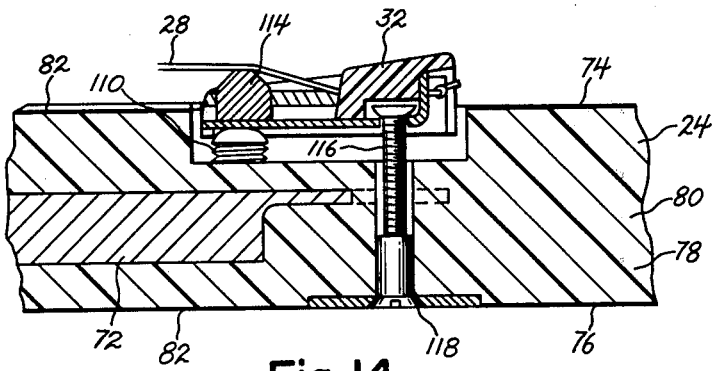
Fig. 14

FOAMED PLASTIC GUITAR CONSTRUCTION

BACKGROUND OF THE INVENTION

This invention relates to stringed musical instruments having a body and neck, and deals more particularly with the construction of such an instrument wherein the body is of the type commonly referred to as a "solid body".

A solid body stringed instrument is one wherein the body, instead of being hollow and having a soundboard which accoustically amplifies the string vibrations, lacks a cavity and a soundboard and carries one or more electrical pickups. These pickups transform the string vibrations into electrical signals which are subsequently amplified and usually modified, and then transformed into sound waves to create sounds related to the string vibrations. Commonly, these bodies have been made from solid pieces of wood which are carved to define their external shapes and to provide various recesses and openings for receiving the bridges, the pickups and other components attached to the bodies. The necks for such solid body instruments have also commonly been made of wood.

Although wood has been widely used in the past for both the bodies and the necks of solid body instruments, wood does have some disadvantageous characteristics. Among these is the fact that it is now a relatively expensive material, particularly in the finer grades most desirable for instrument use. It is also somewhat difficult and costly to work, thereby not lending itself to low cost volume production. In particular, it is rather difficult to produce in mass quantities wooden solid bodies with arched forward or rear surfaces. With wood, it is also somewhat difficult to provide a good joint between the body and the neck and to prevent warpage of the neck due to string tension. And, of course, wood also tends to warp and crack and otherwise deteriorate with age and with changes in temperature, humidity and other environmental factors.

The general object of this invention is, therefore, to provide a stringed musical instrument of the kind having a neck and a solid body and which avoids the use of wood in both the neck and the body.

Another object of this invention is to provide an instrument construction of the foregoing character wherein parts of the body and neck which are customarily made of wood may be given an outer surface with grain and other visual characteristics closely simulating the pleasing appearance of wood.

Another object of this invention is to provide a stringed instrument construction of the foregoing character which enables the bodies and the necks of the instruments to be made at low unit cost with mass production techniques and wherein the disadvantages of wood are avoided. That is, the instrument of the invention is one which is very rugged and very impervious to temperature, humidity and other environmental changes and which also produces a very pleasing sound.

A still further object of this invention is to provide a stringed instrument of the foregoing character wherein a firm, rigid connection exists between the neck and the body which is readily unmade to permit disassembly of the body from the neck for repair or replacement of either the body or the neck.

Another object of the invention is to provide a body for a stringed musical instrument made of a metallic frame and a mass of structural foamed plastic and suitable for use in an instrument of the foregoing character.

Other objects and advantages of the invention will be apparent from the following description and from the drawings forming a part hereof.

SUMMARY OF THE INVENTION

The invention resides in a stringed musical instrument of the type having a body and a neck with the body comprising a metal frame and a unitary mass of plastic in which the frame is embedded with the plastic having a foamed interior and a solid external skin defining the body's general external shape. The frame is in the nature of a flat plate oriented parallel to the forward and rear surfaces of the body and includes at least one opening passing therethrough which receives a portion of the plastic material to assist in locking the frame to the plastic. The metal frame is exposed at one place to provide a support for a bridge and is exposed at another place to provide a bearing surface for cooperation with a neck.

The invention also resides in the stringed instrument having a neck also made of a metallic frame and a unitary mass of plastic, and it further resides in the construction of the joint between the body and the neck whereby the frames are brought into direct metal-to-metal contact with one another to provide a strong solid joint between the neck and body.

BRIEF DESCRIPTION OF THE DRAWINGS

FIG. 12 is an enlarged fragmentary side view partly in elevation and partly in section of the guitar of FIG. 1 taken in the vicinity of the joint between the neck and the body.

FIG. 13 is a fragmentary sectional view taken on the line 13—13 of FIG. 1.

FIG. 14 is a fragmentary sectional view taken on the line 14—14 of FIG. 13.

DETAILED DESCRIPTION OF THE PREFERRED EMBODIMENT

Figure 1:
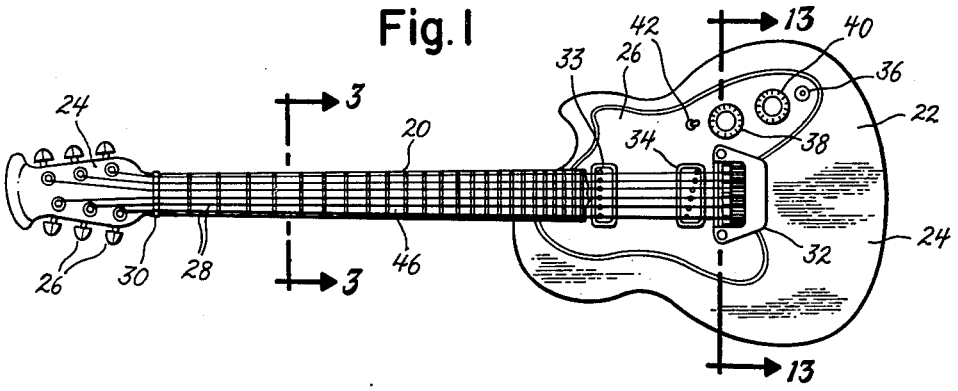
FIG. 1 is a front view of a guitar embodying the present invention.
Figure 2:
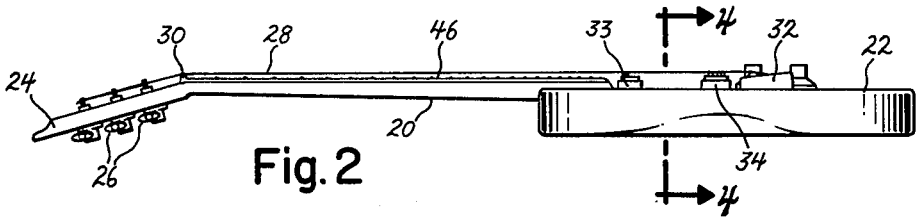
FIG. 2 is a side view of the guitar of FIG. 1.
Figure 3:
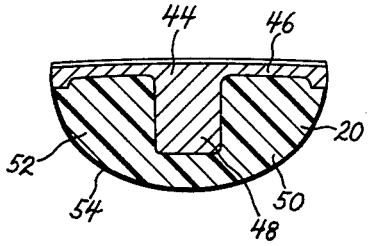
FIG. 3 is an enlarged sectional view taken on the line 3—3 of FIG. 1.
Figure 4:
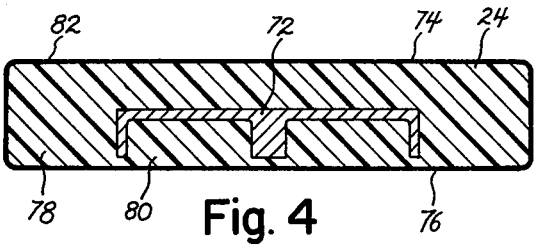
FIG. 4 is an enlarged sectional view taken on the line 4—4 of FIG. 2.

Turning to the drawings and first considering FIGS. 1 and 2, a guitar embodying the invention is shown by these figures to include a neck 20 and a body 22. At the outer end of the neck is a peg head 24 carrying a plurality of tuning machines 26, 26 having posts to which the outer ends of the strings 28, 28 are attached. From these posts, the strings pass over a nut 30 to a bridge 32 carried by the body 22. In the remainder of the description and in the claims which follow, the relative terms "upper", "lower", "forward", and "rear", and their derivatives, are used with it being assumed that the instrument in question is oriented with its peg head uppermost and with its strings facing the viewer. Thus, the neck can be said to extend upwardly from the upper end of the body and FIG. 1 shows the forward surfaces of the body and neck.

The body 22 is of the "solid body" type since it does not include an acoustic air chamber nor a soundboard. Instead, it carries two electrical pickups 33 and 34 which convert the vibrations of the strings into electrical output signals subsequently amplified by an amplifier and converted into sounds by a speaker separate from the instrument. The body 22 includes a main body part 24 and a pick guard 26, in the form of a relatively rigid thin sheet of plastic, attached to the forward surface of the main body part. The electrical signals are output through a jack 36 and their volume and tone may be controlled by operation of a volume control knob 38 and a tone control knob 40. A switch 42 selects between the pickups 33 and 34.

In accordance with the invention, the main body part 24, and also preferably the neck 20, is made of a rigid metallic frame or skeleton surrounded by a mass of structural foamed plastic. As used herein, the term "structural foamed plastic" refers to a plastic such as polyurethane which is foamed by being mixed with a foaming agent and placed in a mold with the result that during the foaming the portions of the plastic which encounter the mold surfaces lose their foaminess and develop a rigid solid skin having an external surface reproducing faithfully, but in reverse, the surface characteristics of the mold. Thus, the mass of plastic in the finished article has a foamed interior and a solid external skin defining the external surface of the article which external surface through proper design of the mold may be given a wood grain effect or any other desired surface texture.

Considering first the construction of the neck 20, and referring to FIGS. 3, 5, 6 and 7, the neck 20 includes a metallic frame 44, made for example of cast aluminum, having along most of its length a wide forward portion 46 providing a fretted fingerboard for the instrument and also having a rearwardly extending central rib 48. Rearwardly of the fingerboard portion 46 of the frame 44 is a mass 50 of foamed plastic having a foamed interior 52 and an external solid skin 54 defining the rounded external rear surface of the neck. The mass of plastic 50 is fixed to the frame 44 as by the plastic material being foamed in place relative to the neck frame. That is, in the foaming process the frame 44 is placed in a mold prior to the mixture of unfoamed plastic and foaming agent being placed therein so that as the plastic foams, it surrounds the frame rib 48 and engages the rear surface of the fingerboard portion 46 to rigidly attach itself to the frame through the surface irregularities of the frame; and, if desired, the frame surfaces involved may be roughened, as by sandblasting, prior to the foaming process to enhance the grip between the plastic foam and the frame.

Figure 6:
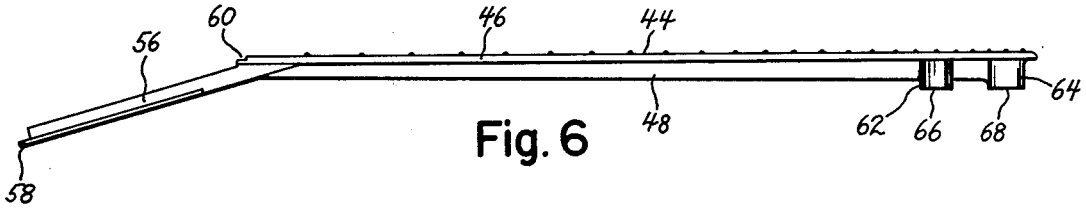
FIG. 6 is a side view of the neck frame of FIG. 5.
Figure 7:
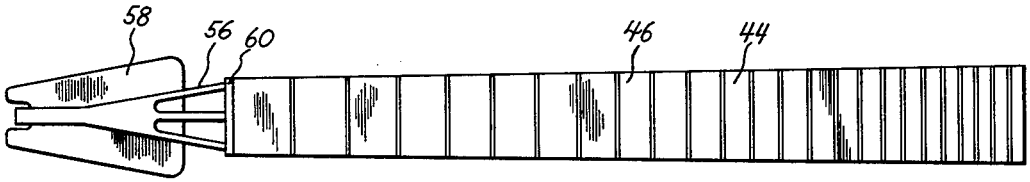
FIG. 7 is a top view of the neck frame of FIG. 6.
Figure 5:
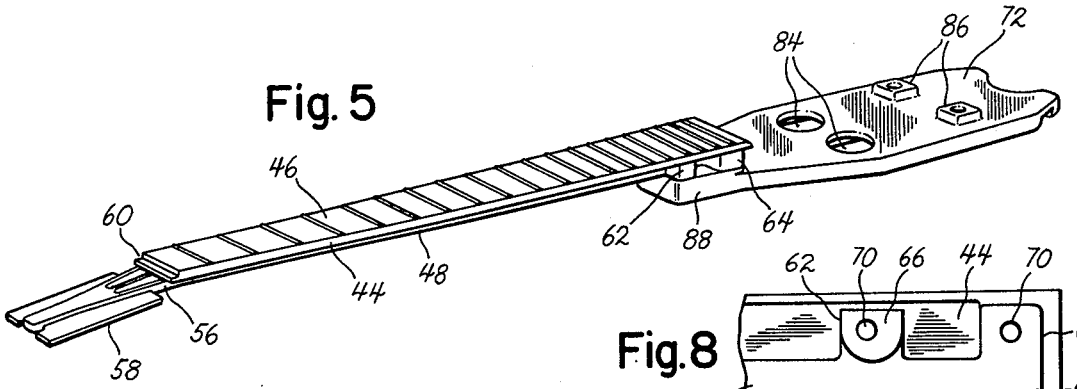
FIG. 5 is a perspective view showing the neck frame and the body frame of the guitar of FIG. 1.

At its outer or upper end, as shown in FIGS. 5, 6, and 7, the neck frame 44 has an end portion 56 which supports a mounting plate 58 providing a base or support for the tuning machines 26, 26, with the plastic of the mass 50 being foamed around the end portion 56 and the plate 58 in the finished neck to provide the bulk and external shape of the peg head. Immediately below the end portion 56 the neck frame 44 includes a transverse rabbet 60 which receives the nut 30 so that the nut rests on and is supported directly by the metal of the frame.

Figure 8:
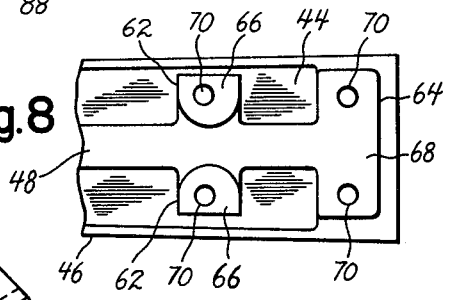
FIG. 8 is a fragmentary bottom view of the lower end of the neck frame of FIGS. 5, 6, and 7.
Figure 9:
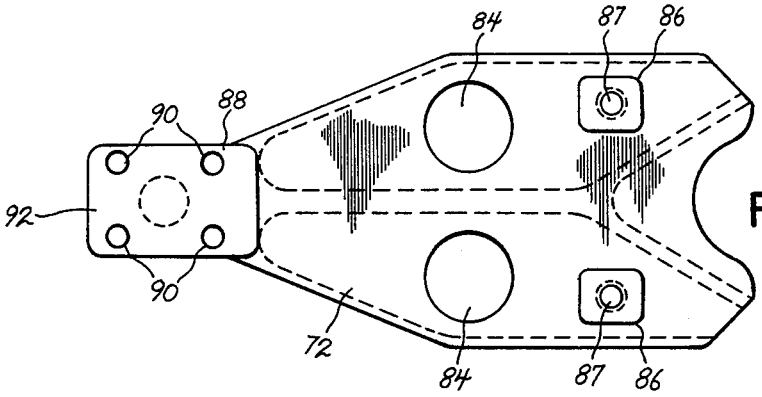
FIG. 9 is a top view of the body frame of FIG. 5.
Figure 10:
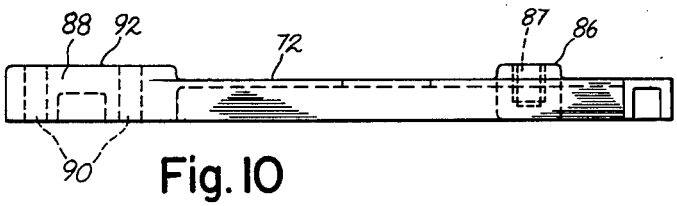
FIG. 10 is a side view of the body frame of FIGS. 5 and 9.

At its lower end, the frame has three bosses 62, 62, and 64 providing three coplanar rearwardly facing bearing surfaces 66, 66 and 68 and four tapped openings 70, 70 as seen best in FIG. 8. The foamed plastic material 50 surrounds the bosses 62, 62, and 64 except that the rearwardly facing bearing surfaces 66, 66 and 68 are exposed to provide, as hereinafter described in more detail, a direct metal-to-metal joint between the neck frame and the body frame.

For the construction of the body 22 reference may be had to FIGS. 4, 5, and 9 to 14. Turning to these figures, the body includes a metallic frame or skeleton 72 in the nature of a relatively broad plate oriented generally parallel to the upper surface 74 and lower surface 76 of the main body part 24. Surrounding this frame 72 is a mass 78 of structural foamed plastic having a foamed interior 80 and a solid (unfoamed) relatively rigid external skin 82. The frame is fixed to the plastic by virtue of the plastic being foamed in place relative to the frame. That is, in the foaming process the frame is placed in a mold prior to the mixture of unfoamed plastic and foaming agent being introduced so that as the foaming takes place the plastic fills the mold and substantially entirely surrounds the frame 72. To assist in locking the frame 72 to the foamed plastic 80 the frame includes two openings 84, 84 passing therethrough from its forward surface to its rear surface and which in the foaming process become filled with the foamed plastic. The frame 72 also includes to bosses 86, 86 with tapped holes 87, 87 and a connecting portion 88 having four through openings 90, 90 and an forwardly facing bearing surface 92.

Figure 11:
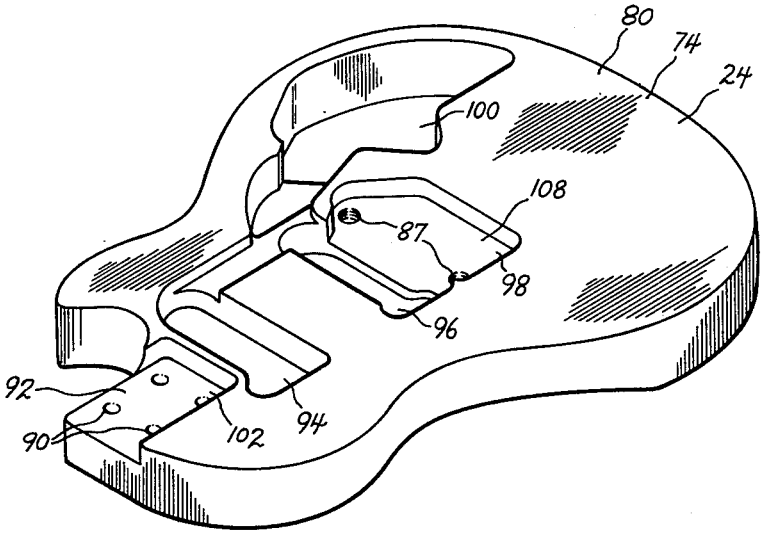
FIG. 11 is a perspective view of the body of the guitar of FIG. 1.

As shown best in FIG. 11, the plastic material 80 of the main body part 24 is formed, preferably by the shape of the mold used in the foaming process, to include a recess 94 for the pickup 33, a recess 96 for the pickup 34, and a recess 98 for the bridge 32. It also includes a recess 100 for receiving a preamplifier, if desired, and other electrical components associated with the jack 36, volume and tone controls 38 and 40, and switch 42. Also, the body part 24 at its upper end includes a recess 102 for receiving the lower end of the neck 20, and this recess 102 includes a forwardly facing root surface part of which is defined by the bearing surface 92 of the body frame. That is, the bearing surface 92 is exposed in the recess 102 to enable a direct metal-to-metal contact to be made between the body frame and the neck frame.

The construction of the joint between the neck and the body is best shown in FIGS. 5 and 12. In particular, the rearwardly facing bearing surfaces 66, 66 and 68 of the neck frame bosses 62, 62 and 64 flatly engage the forwardly facing bearing surface 92 of the body frame portion 88 to provide a direct metal-to-metal contact between the neck frame 44 and body frame 72. The joint is held in tight assembly by four headed screws 104, 104 which pass loosely through the openings 90, 90 in the body frame portion 88 and are threadably received by the tapped openings 70, 70 in the neck frame. The heads of the screws 104, 104 are received in recesses 106, 106 formed in the plastic material of the body part 24 in the vicinity of the openings 90, 90 so that the heads also directly engage the material of the body frame 72. Therefore, when the screws are tightened the body frame 72 is clamped firmly between the neck frame 44 and the heads of the screws. Also, by simply removing the four screws the joint can be quickly unmade to disassemble the neck and body.

The bosses 86, 86 on the body frame 72 provide part of a direct metal-to-metal connection between the bridge 32 and the body frame 72. The strings 28, 28 are, therefore, backed up along their entire span from the nut 30 to the bridge 32 by the metal of the neck frame 44 and the metal of the body frame 72, thus providing a string support having relatively little damping and providing the instrument with a long sustain.

The construction of the bridge and of the means for connecting the bridge to the body frame 72 may vary, but in the illustrated case the bridge recess 98 in the body part 24 has a root surface 108 through which the tapped openings 87, 87 of the bosses 86, 86, and also preferably the forward end surfaces of said bosses, are exposed. As shown best in FIGS. 13 and 14, the tapped openings 87, 87 of the bosses 86, 86 threadably receive end posts 110, 110 with spherical forward surfaces against which the base 112 of the bridge 32 bears and is held by the pressure of the strings. The bridge saddles 114, over which the individual strings 28, 28 pass, are approximately transversely in line with the two end posts 110, 110 so that the rearward pressure of the strings is immediately supported by the end posts 110, 110 and the body frame 72.

Below the end posts 110, 110 is a screw 116 having a head captively and non-rotatively carried by the bridge and a shank threadably received by a nut 118. Thus, by suitable adjustment of the two end posts 110, 110 and the nut 118 the bridge 32 may be raised or lowered or tilted from side to side as need be to bring the strings into proper relationship relative to the fingerboard portion of the neck.

I claim:

1. A stringed musical instrument comprising: a body with upper and lower ends, a neck separate from said body, said means releasably fixing said neck to said body so as to extend upwardly from said upper end of said body, said body comprising a metal body frame and a unitary body mass of plastic substantially surrounding said body frame so as to embed and permanently fix said body frame therein; said body mass of plastic having a solid external skin and a foamed interior with said external skin defining in general the external shape of said body, said skin of said body mass of plastic defining for said body a broad forward body surface and a broad rear body surface generally parallel to one another, said body frame being in the nature of a broad plate spaced from and located intermediate and generally parallel to said forward and rear body surfaces so that portions of said body mass of plastic are located both behind and in front of said frame, said neck comprising an elongated neck frame and a unitary neck mass of plastic fixed to said neck frame and surrounding at least a rear portion thereof, said neck mass of plastic having a foamed interior and a rear external skin providing a rounded rear surface for said neck, said metal body frame being exposed of said body mass of plastic over a portion of said upper end of said body to define a metallic bearing surface, said neck having a lower end portion over part of which said neck frame is exposed of said neck mass of plastic to define a metallic bearing surface complementary to that of said body and directly engaged therewith, said means for releasably fixing said neck to said body including a plurality of headed fasteners passing loosely through one of said frames and threadably received by the other of said frames in the vicinity of and generally perpendicular to said bearing surfaces to releasably hold said bearing surfaces in tight engagement with one another and to thereby provide a rigid joint between said body and said neck.

2. A stringed musical instrument as defined in claim 1 further characterized by said broad forward surface of said body including a bridge recess with a root surface, and a bridge mechanism located in said bridge recess, said bridge mechanism including two metallic adjustment posts threadably connected with said metallic frame and extending forwardly from said base surface of said bridge recess, and a bridge unit bearing against the forward ends of said posts.

3. A stringed musical instrument as defined in claim 2 further characterized by said neck having a peg head at its upper end carrying a plurality of string tensioning machines, a nut, and a plurality of strings each connected to a respective one of said machines and extending over said nut to said bridge, said nut resting directly on said metal neck frame whereby said neck frame and said body frame in combination provide a continuous metallic support extending the full length of each string between said nut and said bridge mechanism.

4. A stringed musical instrument comprising: a body with upper and lower ends, a neck separate from said body, and means releasably fixing said neck to said body so as to extend upwardly from said upper end of said body, said body comprising a metal body frame and a unitary body mass of plastic substantially surrounding said body frame so as to embed and permanently fix said body frame therein; said body mass of plastic having a solid external skin and a foamed interior with said external skin defining in general the external shape of said body, said skin of said body mass of plastic defining for said body a broad forward body surface and a broad rear body surface generally parallel to one another, said body frame being in the nature of a broad plate spaced from and located intermediate and generally parallel to said forward and rear body surfaces so that portions of said body mass of plastic are located both behind and in front of said frame, said neck comprising an elongated neck frame and a unitary neck mass of plastic fixed to said neck frame and surrounding at least a rear portion thereof, said neck mass of plastic having a foamed interior and a rear external skin providing a rounded rear surface for said neck, said metal body frame being exposed of said body mass of plastic over a portion of said upper end of said body to define a metallic bearing surface, said neck having a lower end portion over part of which said neck frame is exposed of said neck mass of plastic to define a metallic bearing surface complementary to that of said body and directly engaged therewith, said means for releasably fixing said neck to said body including a plurality of headed threaded fasteners passing loosely through at least one of said frames generally perpendicular to said bearing surfaces and threadably engaged with correspondingly threaded means to releasably hold said bearing surfaces in tight engagement with one another and to thereby provide a rigid joint between said body and said neck.

* * * * *